US008590341B2

(12) United States Patent
MacMaster

(10) Patent No.: US 8,590,341 B2
(45) Date of Patent: Nov. 26, 2013

(54) MULTIFUNCTIONAL JEWELRY

(76) Inventor: Anna MacMaster, Revere, MA (US)

( * ) Notice: Subject to any disclaimer, the term of this patent is extended or adjusted under 35 U.S.C. 154(b) by 182 days.

(21) Appl. No.: 13/020,172

(22) Filed: Feb. 3, 2011

(65) Prior Publication Data

US 2011/0239703 A1 Oct. 6, 2011

Related U.S. Application Data

(60) Provisional application No. 61/341,653, filed on Apr. 3, 2010.

(51) Int. Cl.
*A44C 9/02* (2006.01)

(52) U.S. Cl.
USPC ..... 63/15.5; 63/1.17; 63/3.2; 63/40; 63/43; 132/273; 132/275

(58) Field of Classification Search
USPC ..... 63/3, 3.1, 3.2, 5.1, 6, 11, 15, 15.45, 63/15.5, 15.65, 33, 40, 41, 29.1, 29.2, 43, 63/1.17; 132/275, 273
See application file for complete search history.

(56) References Cited

U.S. PATENT DOCUMENTS

| | | | | | |
|---|---|---|---|---|---|
| 397,833 | A | * | 2/1889 | Colby et al. | 63/11 |
| 400,578 | A | * | 4/1889 | Luthy | 63/6 |
| 421,615 | A | * | 2/1890 | Riker | 63/11 |
| 429,039 | A | * | 5/1890 | Kienle | 63/11 |
| 433,033 | A | * | 7/1890 | Regnell | 63/15.5 |
| 434,220 | A | * | 8/1890 | Whitney | 63/11 |
| 861,638 | A | * | 7/1907 | Condory | 63/15.5 |
| 946,342 | A | * | 1/1910 | Doppenschmitt | 63/11 |
| 993,303 | A | * | 5/1911 | Kirby | 63/11 |
| 1,797,583 | A | * | 3/1931 | Miller | 428/608 |
| 4,334,413 | A | * | 6/1982 | Gaston et al. | 63/3.2 |
| 5,247,814 | A | * | 9/1993 | McDonald | 63/3.2 |
| 5,307,582 | A | * | 5/1994 | Quintel | 40/633 |
| 5,664,439 | A | * | 9/1997 | Dickerson | 63/33 |
| 5,857,468 | A | | 1/1999 | Camp, Jr. et al. | |
| 5,901,713 | A | * | 5/1999 | Mroczek | 132/273 |
| 6,523,549 | B1 | | 2/2003 | Frame et al. | |
| 7,581,548 | B2 | | 9/2009 | Henricksen et al. | |
| 2004/0237992 | A1 | | 12/2004 | Klug | |

OTHER PUBLICATIONS

International Preliminary Report on Patentability for International Patent Application No. PCT/US2011/031089 issued on Oct. 9, 2012, 5 pages.
International Search Report and Written Opinion in counterpart international application No. PCT/US2011/031089, dated Jan. 19, 2012. 9 pages.

* cited by examiner

*Primary Examiner* — Jack W. Lavinder
*Assistant Examiner* — Abigail E Morrell
(74) *Attorney, Agent, or Firm* — Schmeiser, Olsen & Watts, LLP; Timothy P. Collins

(57) ABSTRACT

Described are multifunctional jewelry rings and methods comprising a ring band section, a base, a restraining device, and a ring top. The restraining device has a central portion extending through the base and the ring band section and has first and second end portions extending from a bottom surface of the base. In a first state, the restraining device holds a finger in place against the ring band section. In a second state, the restraining device holds a bundle of hair together against the ring band section. The ornamental ring top is removably attached to the base.

14 Claims, 15 Drawing Sheets

MULTIFUNCTIONAL JEWELRY

RELATED APPLICATIONS

This application claims the benefit of U.S. Provisional Patent Application No. 61/341,653, filed Apr. 3, 2010, the content of which is incorporated by reference herein in its entirety.

FIELD OF THE INVENTION

The present invention relates generally to the field of jewelry, and more specifically, to multifunctional jewelry that can be worn as a finger ring or as a hair accessory.

BACKGROUND

Jewelry rings are often worn for reasons related to fashion, for example, to match the shape, color, motif, or jewel on the ring with an article of clothing. Other jewelry rings such as wedding rings are worn as an indicator of the wearer's status. Such jewelry rings generally include a metal ring band having a set of fixed dimensions, for example, a diameter sufficient to receive a finger. Many jewelry rings include a bezel or a set of prongs that extend from the ring band that hold a gem or other design piece in place against the ring band.

Hair accessories, for example, elastic hair bands or hair clips, can also be worn for reasons related to fashion, and/or for practical reasons such as for preventing strands of hair from falling in front of a wearer's eyes. Fashion hair bands can include expensive jewels or design pieces. Unlike finger ring bands, a hair band must be sufficiently flexible to hold a bundle of hair in place, for example, by creating one or more loops about the bundle of hair.

Hair bands often become lost when not in use. While some hair band wearers keep several hair bands available in anticipation of loss, some hair bands such as fashion hair bands can be expensive, especially those including jewels or design pieces.

SUMMARY

An embodiment features a multifunctional jewelry ring comprising a ring band section, a base, and a flexible restraining device. The ring band section is configured to receive at least one of a finger and a bundle of hair. The base is coupled to the ring band section. The flexible restraining device has a central portion extending through the base and the ring band section and has first and second end portions extending from a bottom surface of the base. In a first state, the restraining device holds the finger in place against the ring band section. In a second state, the restraining device holds the bundle of hair together against the ring band section. An ornamental ring top can be removably attached to the base.

Another embodiment features a method of forming a multifunctional jewelry ring. A method includes configuring a ring band section to receive at least one of a finger and a bundle of hair. The method further includes coupling a base to the ring band section. The method further includes extending a flexible restraining device through the base and the ring band section such that a first end portion of the restraining device extends from a first end of the ring band section and a second end portion of the restraining device extends from a second end of the ring band section. The method further includes configuring the restraining device is configured in a first state. The restraining device holds the finger in place against the ring band section. The method further includes configuring the restraining device in a second state. The restraining device holds the bundle of hair together against the ring band section. The method includes positioning an ornamental ring top on the base.

BRIEF DESCRIPTION OF THE DRAWINGS

The above and further advantages of this invention may be better understood by referring to the following description in conjunction with the accompanying drawings, in which like numerals indicate like structural elements and features in various figures. The drawings are not necessarily to scale, emphasis instead being placed upon illustrating the principles of the invention.

DETAILED DESCRIPTION

In the following description, specific details are set forth although it should be appreciated by one of ordinary skill that the present invention can be practiced without at least some of the details. In some instances, known features or processes are not described in detail so as not to obscure the present invention.

The present teaching will now be described in more detail with reference to exemplary embodiments thereof as shown in the accompanying drawings. While the present teaching is described in conjunction with various embodiments and examples, it is not intended that the present teaching be limited to such embodiments. On the contrary, the present teaching encompasses various alternatives, modifications and equivalents, as will be appreciated by those of skill in the art. Those of ordinary skill having access to the teaching herein will recognize additional implementations, modifications and embodiments, as well as other fields of use, which are within the scope of the present disclosure as described herein.

Embodiments of multifunctional jewelry described herein include a jewelry ring that can be configured to be worn as a hair accessory, referred to as a hair ring, and converted to a finger ring when not used as a hair accessory, or vice versa. The jewelry ring can be worn as either a finger ring or a hair ring for fashion-related reasons or for practical reasons. Thus, a wearer is not required to store the jewelry ring in a separate location when not worn as a hair accessory, since the jewelry ring can be readily worn on a finger, and can be converted from a finger ring to a hair ring when the wearer desires to wear the jewelry ring as a hair accessory. The jewelry ring includes a removable ring top, which can include a jewel, stone, scarab, motif, or other ornamental ring top design piece, permitting the jewelry ring to have different design configurations. Thus, fashion-conscious wearers can coordinate the jewelry ring to match clothing or other accessories such as handbags and the like, regardless of whether the jewelry ring is configured as a finger ring or as a hair accessory.

Figure 1A:
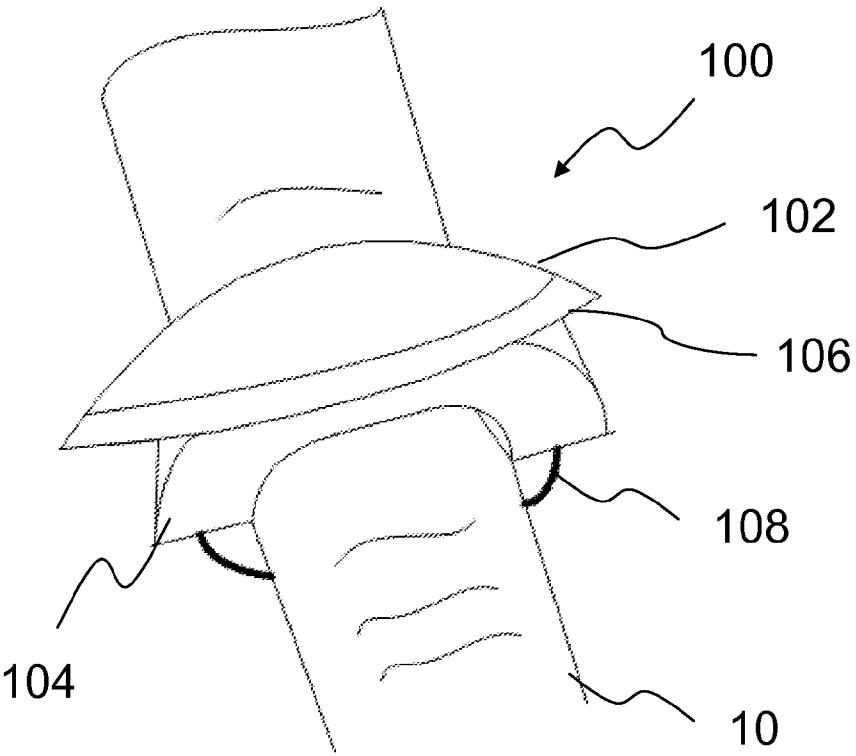
FIG. 1A is a perspective view of an embodiment of a multifunctional jewelry ring, as worn on a finger.
Figure 1B:
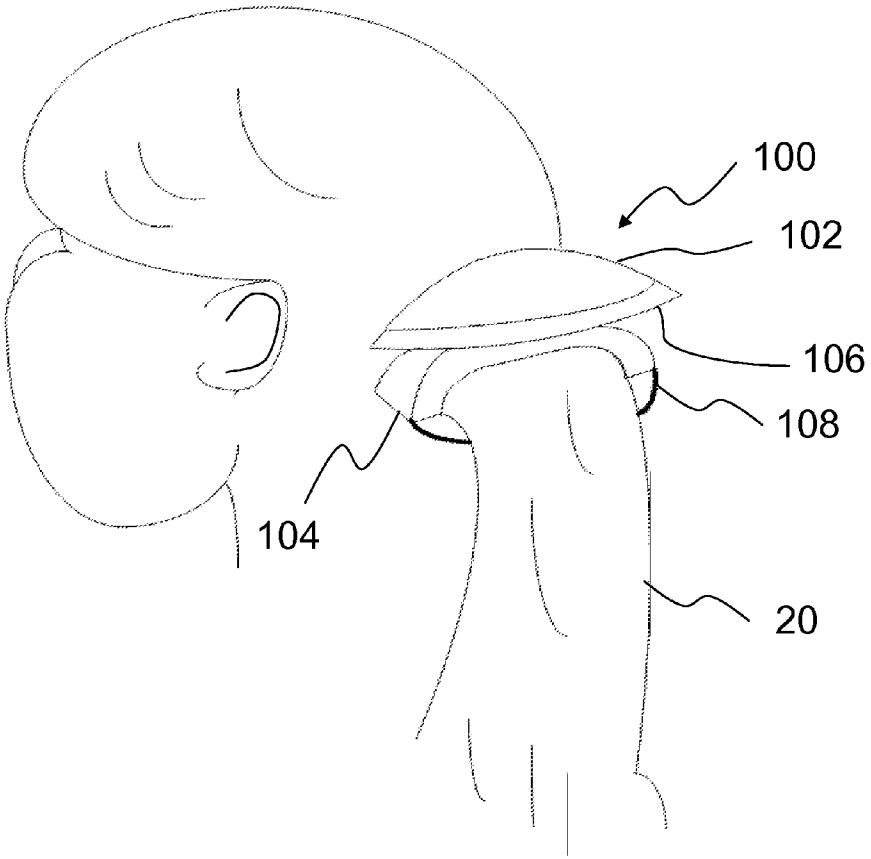
FIG. 1B is a perspective view of an embodiment of the multifunctional jewelry ring of FIG. 1A, as worn about a bundle of hair.

FIG. 1A is a perspective view of an embodiment of a multifunctional jewelry ring 100, as worn on a finger 10. FIG. 1B is a perspective view of an embodiment of the multifunctional jewelry ring 100 of FIG. 1A, as worn about a bundle of hair 20. The multifunctional jewelry ring 100 includes a ring band section 104, a base 106, a restraining device 108, and a ring top 102.

The ring band section 104 is configured for positioning on a top portion of a finger 10, or about a first portion of a bundle of hair 20, for example, a portion of a ponytail, a pigtail, or a braid. An inner surface of the ring band section 104 can be configured to have a shape of a parabola, arch, semi-circle, or other curvilinear shape for positioning about a finger and/or at least a portion of hair. Accordingly, the restraining device 108 can be positioned about a second portion of the bundle of hair 20 to hold the first and second portions of the bundle of hair 20 in place, or to hold the jewelry ring 100 in place on the finger 10. The ring band section 104 can be molded or machined from materials such as a metal, alloy, plastic, or a combination thereof. The metal or alloys can include precious metals such as gold, silver, platinum, and the like, and/or can include other metals such as copper, aluminum, and the like.

The restraining device 108 extends between a first end 110*a* and a second end 110*b* of the ring band section 104. The restraining device 108 can include a strap, string, band, or other thin strip of fabric formed of materials that hold the finger 10 or bundle of hair 20 in place against the ring band section 104 during use. The restraining device 108 can be fabricated from rubber, polyurethane fiber, nylon, polyester, cotton, acrylic, plastic, silicone, or a combination thereof, or other materials known to those of ordinary skill in the art having elastic properties that permit the restraining device 108 to expand beyond an initial state when a force is applied thereto. The restraining device 108 substantially restrains the wearer's finger 10 or hair strands of the bundle of hair 20 against the ring band section 104, regardless of the elasticity of the restraining device 108. In another embodiments, the restraining device 108 includes elements including but not limited to plastics, metals or alloys, for example, precious or semi-precious metals or alloys, and the like. In other embodiments, the restraining device 108 is formed entirely of metals or plastics, which can be pliable for conforming about a finger and/or a bundle of hair, or have inelastic properties, but can be preconfigured for positioning about a finger or a bundle of hair.

The base 106 is attached to the ring band section 104. The restraining device 108 is positioned in the base, except for the two end portions extending from the first end 110*a* and the second end 110*b* of the ring band section 104. The base 106 can include but not limited to metals, for example, precious metals or semi-precious metals, plastics, magnetic materials, ceramics, or machined or molded materials. The ring top 102 can be removably attached to the base 106. The ring top 102 can be removed from the base 106 and replaced with a different ring top according to the decorative or functional needs of the wearer. Thus, different ring tops 102 can be attached to the base 106, each having a unique ornamental configuration, color, jewel, shape, and the like, depending on the requirements of the wearer for reasons related to fashion, function, aesthetic appeal, and the like. The ring top 102 can include a jewel, ornamental stone, scarab, motif, or other ring top design piece. The ring top 102 can comprise acrylic, glass, plastics, stones, gemstones, cubic zirconium or other faux gemstone, feathers, or other fashion-related items. The ring top 102 can be hollow or solid throughout the body of the ring top 102. The ring top 102 can have a shape of a dome, semi-circle, or other shape that permits the ring top 102 to be secured to the base 106.

Figure 2:
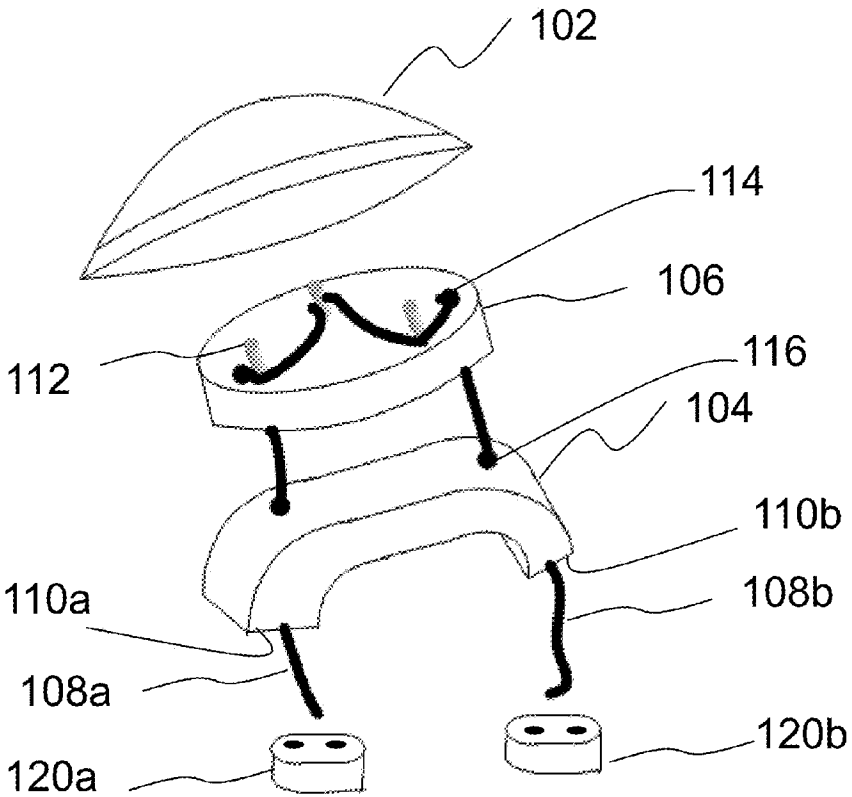
FIG. 2 is an exploded perspective view of an embodiment of the jewelry ring of FIGS. 1A and 1B.

FIG. 2 is an exploded perspective view of an embodiment of the multifunctional jewelry ring 100 of FIGS. 1A and 1B.

The base 106 includes at least three poles 112 that are positioned about a top surface of the base 106. A central portion of the restraining device 108 is threaded about the poles 112 to hold the restraining device 108 in place in the base 106 during use. The poles 112 can permit an additional length of restraining device 108 to be stored in the base 106 for use as a hair ring or a finger ring. The poles 112 can be spools that rotate freely about an axis that is perpendicular to the surface of the base 106 when the restraining device 108 is expanded or contracted during a transition of the jewelry ring 100 between a hair ring configuration and a finger ring configuration. Alternatively, the poles can be affixed to the surface of the base 106.

The base 106, in particular, the poles 112 of the base 106 or other components on the base, can be encased in a ring casing (not shown) formed on the surface of the base 106, and shaped to receive the ring top 102. The ring casing can include but not limited to metals, for example, precious metals or semi-precious metals, plastics, magnetic materials, ceramics, clays, or machined or molded materials. The ring casing of the base 106 can include magnetic properties, permitting the ring top 102 to be magnetically coupled with the base 106. In other embodiments, for example, shown in FIGS. 7-10, one of the ring top 102 can the base 106 can include a fastening device such as a screw that is inserted into a threaded hole in the other of the ring top 102 and the base 106, permitting the ring top 102 to be held in place against the base 106. In embodiments that include a ring casing, the ring casing can include a fastening device or a hole for receiving a fastening device, for example, a hole including a thread for receiving a screw extending from the ring top 102.

The base 106 includes two holes 114 that extend through the base 106. The two holes 114 can be on opposite sides of the base 106 from each other. The holes 114 can be proximal to an outer perimeter of the base 106. The ring band section 104 can also include two holes 116, each hole 116 extending through regions proximal to the ends 110*a*, 110*b*, respectively, of the ring band section 104. Each hole 114 of the base 106 is aligned with a hole 116 in the ring band section 104. Accordingly, two continuous uninterrupted holes can be formed by the holes 114, 116, the continuous uninterrupted holes extending through the base 106 and the ring band section 104. End portions of the restraining device 108 can extend from the central portion of the restraining device 108 threaded about the poles 112 in the base 106 through the uninterrupted holes formed by the holes 114, 116.

In other embodiments, the base 106 can include a tension spring (not shown) instead of poles 112 for housing at least a portion of the restraining device 108. The tension spring can be configured to extend and retract the restraining device 108. One end of the restraining device 108 can be attached to the spring and wrap around an interior or exterior of the spring when the jewelry ring 100 is configured as a finger ring. The other end of the restraining device 108 can be affixed to a surface of the jewelry ring 100, wherein when the jewelry ring 100 is converted from a finger ring to a hair ring, the wearer can pull the restraining device 108 to extend the restraining device 108 from a different region of the jewelry ring 100 than the region to which the other end of the restraining device 108 is affixed. The tension spring can be configured to retract the restraining device 108 when returning the jewelry ring 100 to a finger ring configuration.

Figure 4:
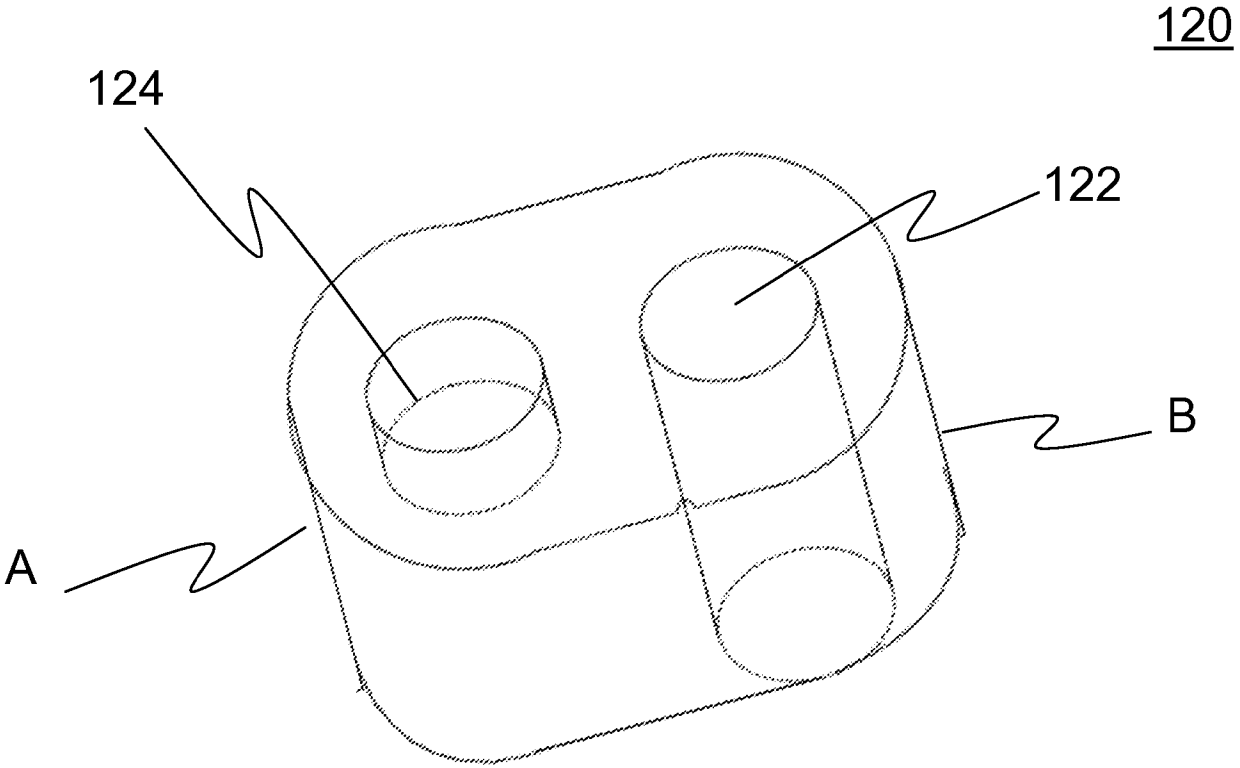
FIG. 4 is a close-up perspective view of an embodiment of a shank and elastic assembly of a multifunctional ring.

The multifunctional jewelry ring 100 further includes two shanks 120, namely, a first shank 120*a* and a second shank 120*b*. A close-up view of an embodiment of a shank 120 is shown in FIG. 4, corresponding to at least one of the first shank 120*a* and/or the second shank 120*b*. The shank 120 can be formed of a metal, alloy, plastic, or a combination thereof. The shank 120 can include precious metals such as gold, silver, platinum, and the like, or can include other metals such as copper, aluminum, and the like. The shank 120 can include a magnetic material, for example, a ferrous metal, for magnetically attaching to the base 106, to the ring band section 104, or to another shank.

The shank 120 includes a first side A and a second side B. The shank 120 can include a hole 122 that extends through the shank 120 in a region proximal to the second side B. The hole 122 has a diameter that permits the restraining device 108 to travel through the hole 122 when transitioning between a hair ring configuration and a finger ring configuration. The shank 120 can also include a terminating hole 124 that extends through at least a portion of the shank 120 in a region proximal to the first side A. An end of the restraining device 108 terminates in the terminating hole 124, and is secured in the terminating hole 124 by glue or other well-known attachments.

The shank 120 can be formed of a single stock of material. Alternatively, the shank 120 can be formed a first stock of material, which includes hole 122, and a second stock of material, which includes the terminating hole 124, which are attached together by welding, glue, or other well-known attachment means. The shank 120 can be shaped as a rectangle, hour-glass, and the like, or shaped according to a custom design, for example, a teddy bear, a rose, a dragonfly, etc. In embodiments where the shank is formed of two different stocks of material that are fixedly attached to each other, each stock of material can be shaped as a ball, square, or other shape having dimensions that permit the shank 120 to perform the features and functions described herein, for example, to connect the two ends of the restraining device 108 together when configuring the jewelry ring 100 as a hair ring.

Returning to FIG. 2, the multifunctional jewelry ring 100 is assembled by attaching the base 106 to a top portion of the ring band section 104. A top portion of the ring band section 104 can be substantially flat so that the base 106 can be glued, screwed, or otherwise affixed to the ring band section 104. In another embodiment, the ring band section 104 and the base 106 is formed from a single stock, which is machined or molded to form the base 106 and the ring band section 104.

Figure 3:
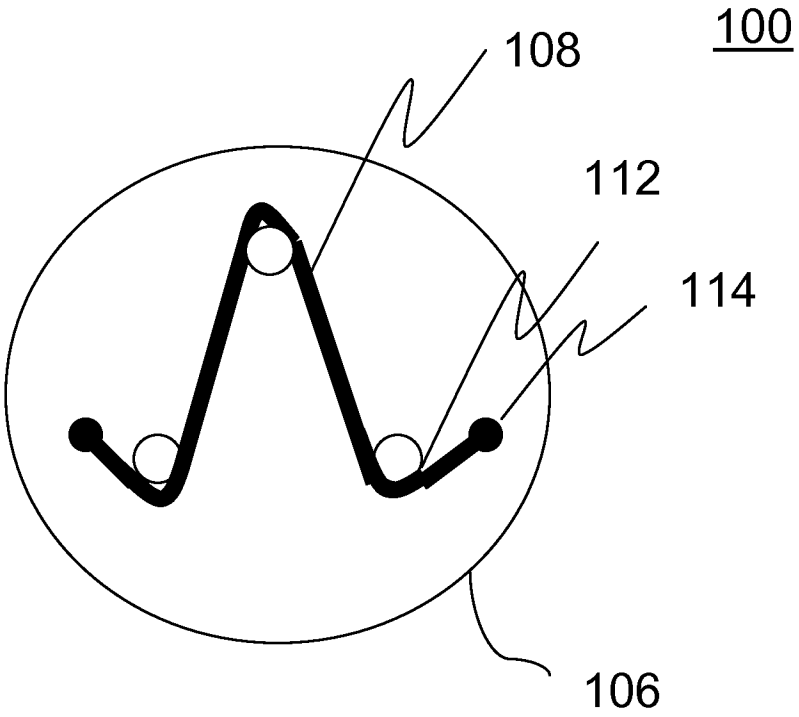
FIG. 3 is a cutaway top view of an embodiment of the interior region of the base of FIGS. 1A, 1B, and 2.

As shown in FIG. 3, the restraining device 108 can include a single elongate body, which extends from the first end 110*a* of the fixed band section 104 through the base 106 to the second end 110*b* of the fixed band section 104. As shown in FIG. 3, the restraining device 108 can extend from a first hole 116 in the ring band section 104 through a first hole 114 in the base 106, extend around the poles 112 on the base 106 in a threaded pattern, through a second hole 114 in the base 106, through a second hole 116 in the ring band section 104, and through the second end 110*b* of the fixed band section 104. A first end of the restraining device 108 proximal to the first end 110*a* of the fixed band section 104 is attached to the first shank 120*a*, and a second end of the restraining device 108 proximal to the second end 110*b* of the fixed band section 104 is attached to the second shank 120*b*.

The ring top 102 is positioned on the base 106. The ring top 102 can have a shape, for example, a dome or bowl-shaped interior, for secure positioning on the base 106, and for enclosing the poles 112 and/or material (not shown) encasing the poles 112. An outer perimeter of the ring top 102 can be directly attached to a corresponding perimeter region of the base 106, for example, an outermost edge of the base. In an embodiment, the ring top 102 includes a substantially flat bottom surface, which is positioned on a flat surface of the base 106, for example, a top surface of the material encasing the base.

At least one of the ring top 102 and the base 106 can include a magnet for holding the ring top 102 in place against the base 106. In an embodiment, the ring top 102 includes a material that produces a magnetic field and the base 106 includes a material that is attracted to the magnetic material of the ring top 102. In another embodiment, the base 106 includes a material that produces a magnetic field and the ring top 102 includes a material that is attracted to the magnetic material of the ring top 102. In another embodiment, the ring top 102 and the base 106 each includes a magnetic material. In another embodiment, a perimeter of the base 106 includes a screw thread, and the ring top 102 is configured for screwing into the base 106 via the screw thread. In other embodiments, the base 106 includes prongs, a bezel, or other attachment elements that hold the ring top 102 in place against the base 106. The ring top 102 can be attached to the base 106 in a threaded screw configuration, pressure lock configuration, screws, clamps, or other well-known coupling schemes.

Figure 5A:
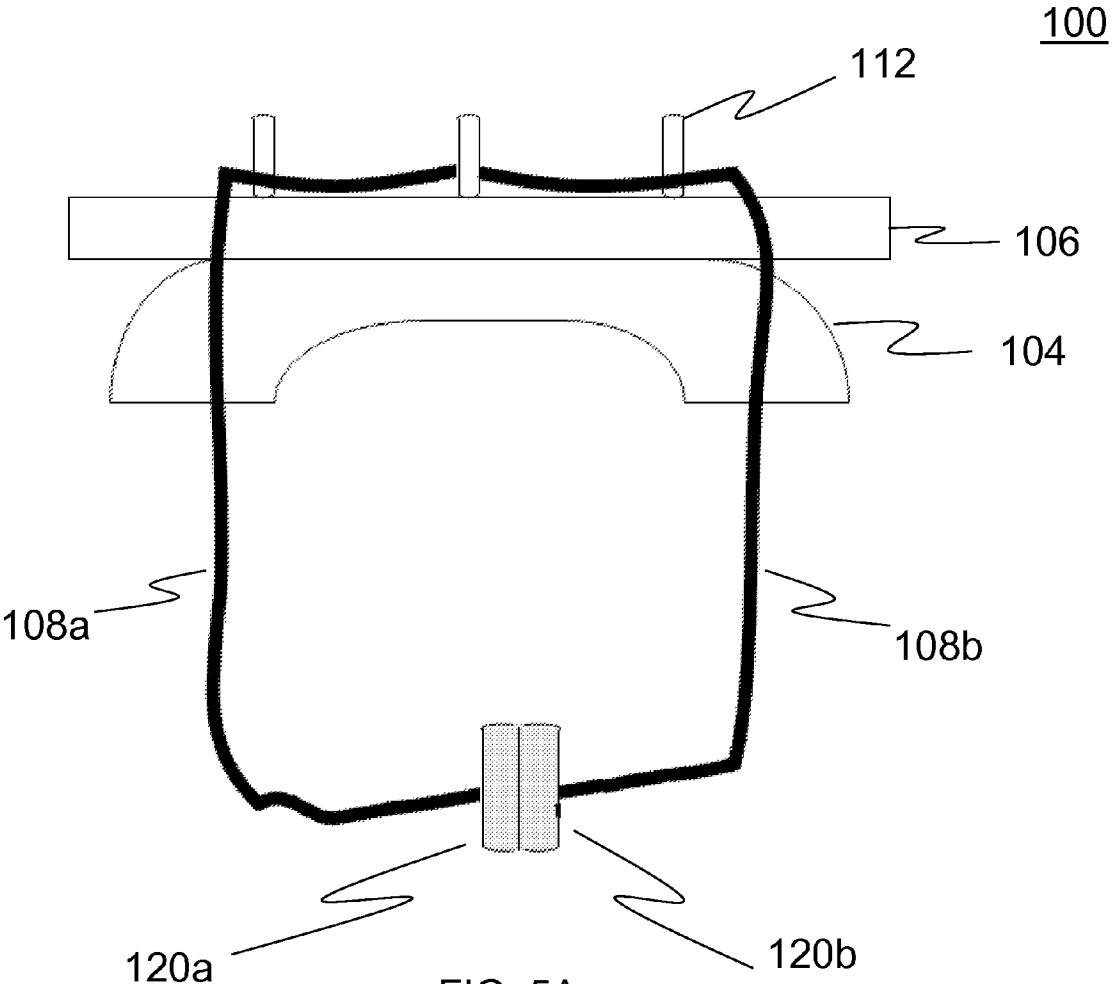
FIG. 5A is a cross-sectional front view of an embodiment of the jewelry ring of FIGS. 1-4, configured for wearing about a bundle of hair.

FIG. 5A is a cross-sectional front view of an embodiment of the jewelry ring 100 of FIGS. 1-4, configured for wearing about a bundle of hair.

The restraining device 108 is configured having an open position, or a single continuous loop, which extends from a first section 108*a* through the base 106 and the ring band section 104 to a second section 108*b* as described above with reference to FIG. 2. The first section 108*a* of the restraining device 108 protrudes from the first end 110*a* of the ring band section 104 and extends through the hole 122 in the first shank 120*a* to the terminating hole 124 in the second shank 120*b*, where the first end 128*a* of the restraining device 108 is affixed in the terminating hole 124 of the second shank 120*b*. Similarly, a second section 108*b* of the restraining device 108 protrudes from the second end 110*b* of the ring band section 104 and extends through the hole 122 in the second shank 120*b* to the terminating hole 124 in the first shank 120*a*, where the second end 128*b* of the restraining device 108 is affixed in the terminating hole 124 of the first shank 120*a*.

In FIG. 5A, the first shank 120*a* and the second shank 120*b* are attached to each other, for example, magnetically attached, such that a single loop is formed by the restraining device 108, in particular, by the first section 108*a* and the second section 108*b*. The first and second shanks 120*a*, 120*b* can each be magnetic, but of opposite polarity, permitting the shanks 120*a*, 120*b* to attach to each other. Alternatively, one shank can be magnetic, while the other shank can be attracted to the magnetic shank. Alternatively, the first and second shanks 120*a*, 120*b* can be coupled together by a clasp arrangement or other well-known coupling configuration. Although a single loop is formed by the restraining device 108, the single loop can be configured to form multiple loops to hold a bundle of hair in place.

Figure 5B:
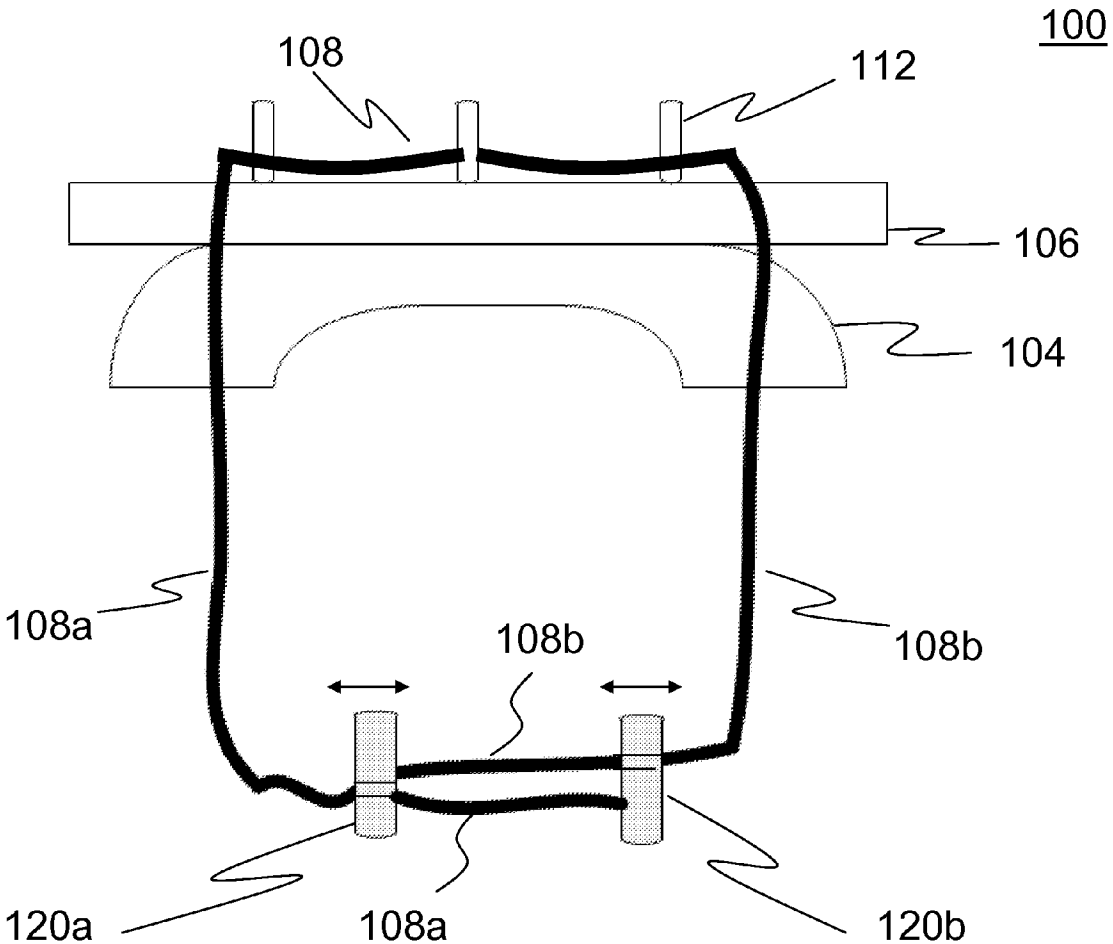
FIG. 5B is a cross-sectional front view of an embodiment of the jewelry ring of FIG. 5A transitioning from an open position to a closed position.
Figure 5C:
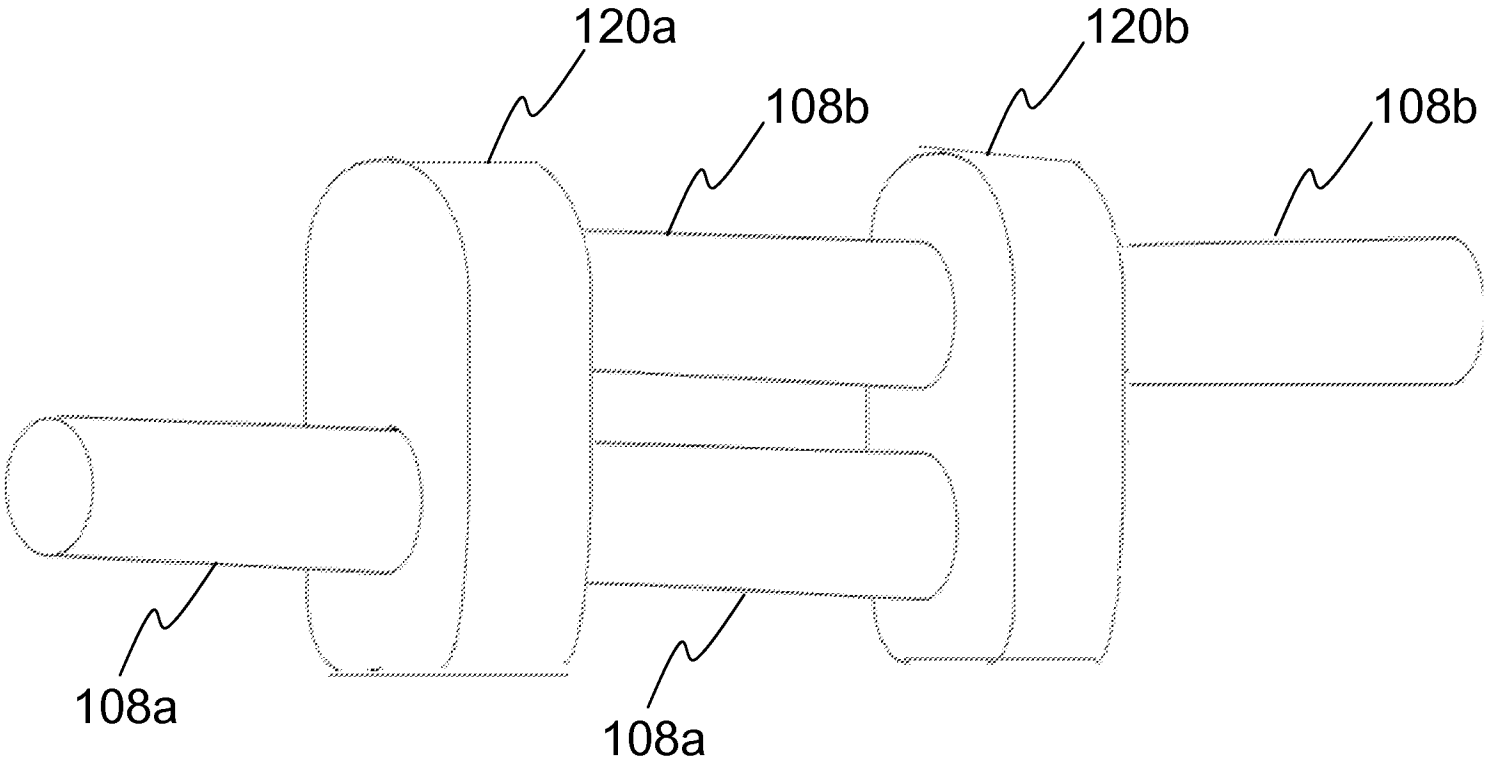
FIG. 5C is a blow-up of an embodiment of a shank and elastic assembly of FIG. 5B.

FIG. 5B is a cross-sectional front view of an embodiment of the multifunctional jewelry ring 100 of FIG. 5A transitioning from an open position to a closed position. FIG. 5C is a blow-up of the shank and elastic assembly of FIG. 5B.

The first shank 120*a* and the second shank 120*b* are separated from each other by applying a force to at least one shank. For example, a manual force can be applied to the first shank 120*a* to move the first shank 120*a* toward the first end 110*a* of the ring band section 104, and a manual force applied to the second shank 120*b* to move the second shank 120*b* away from the first shank 120*a* and toward the second end 110*b* of the ring band section 104. In doing so, the second shank 120*b* is coupled to an end of the first section 108*a* of the restraining device 108 and moves along the second section 108*b* of the restraining device 108, and the first shank 120*a* is coupled to an end of the second section 108*b* and moves along the first section 108*a* of the restraining device 108.

Figure 5D:
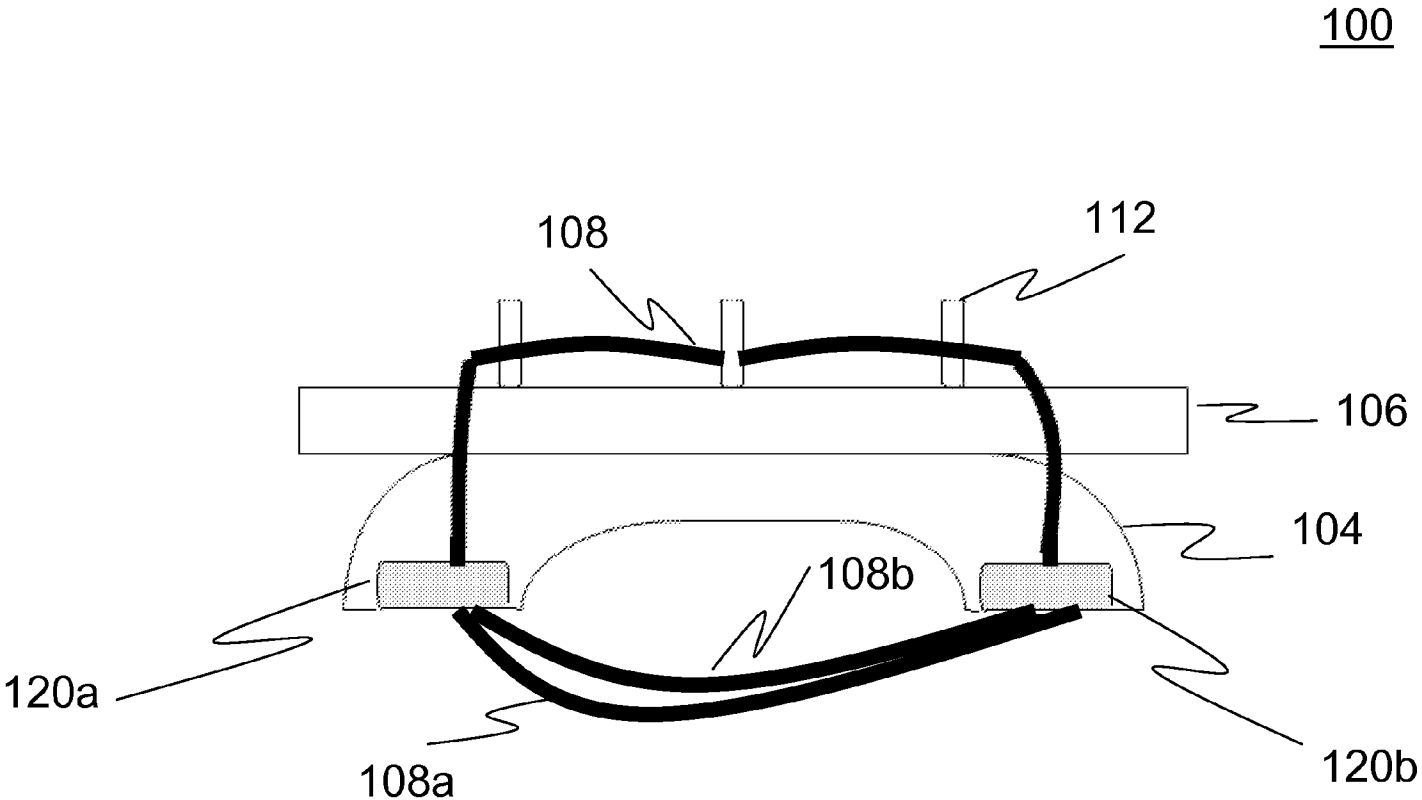
FIG. 5D is a cross-sectional front view of an embodiment of the jewelry ring of FIGS. 1-5C, configured for wearing about a finger.
Figure 6:
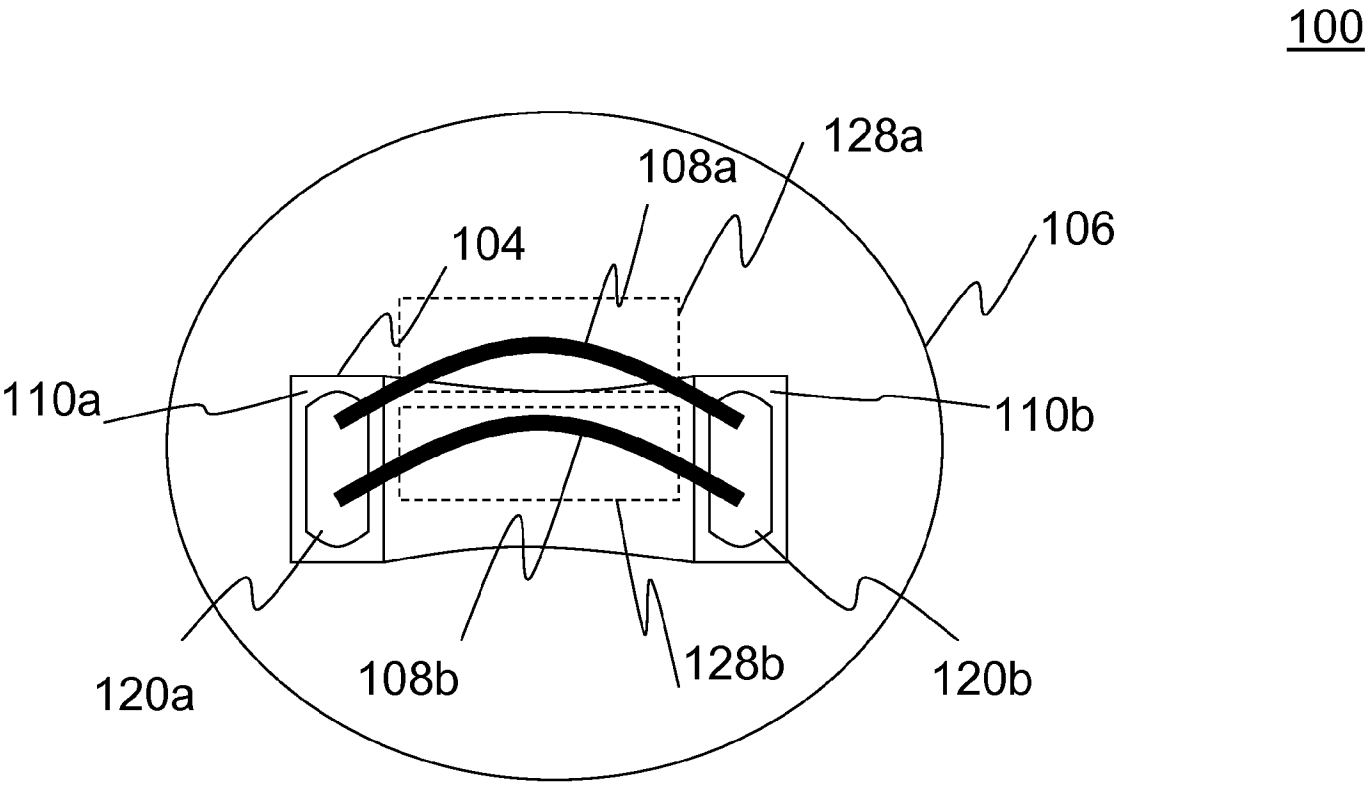
FIG. 6 is a bottom view of an embodiment of the finger ring of FIG. 5D.

FIG. 5D is a cross-sectional front view of an embodiment of the jewelry ring of FIGS. 1-5C, configured for wearing about a finger. FIG. 6 is a bottom view of an embodiment of the jewelry ring 100 of FIG. 5D.

In placing the jewelry ring 100 in a closed position, the first shank 120*a* can be inserted in an opening at each of the first end 110*a* of the ring band section 104, and the second shank 120*b* can be inserted in a second end 110*b* of the ring band section 104. In an embodiment, the first and second shanks 120*a*, 120*b* are secured in the ends 110*a*, 110*b* of the ring band section 104, for example, by a magnet in at least one of the shanks 120*a*, 120*b* and the ends 110*a*, 110*b* of the ring band section 104. In another embodiment, in the absence of a ring band section 104, the first and second shanks 120*a*, 120*b* are magnetically coupled to the surface of the base 106.

A first finger ring region 128*a* is formed by the first section 108*a* of the restraining device 108 from the first end 110*a* to the second end 110*b* of the ring band section 104. A second finger ring region 128*b* is formed by the second section 108*b* of the restraining device 108 from the first end 110*a* to the second end 110*b* of the ring band section 104. A finger can be inserted into the first and second finger ring regions 128*a*, 128*b*, and held in place against the ring band section 104 by the first and second sections 108*a*, 108*b* of the restraining device 108. One or both of the first and section sections 108*a*, 108*b* can be adjusted to increase or decrease the size of the first finger ring region 128*a* and/or the second finger ring regions 128*b*. For example, the first and/or second finger ring regions 128*a*,128*b* can be increased by removing the first shank 120*a* and/or the second shank 120*b* from their position in the first end 110*a* and/or second end 110*b* of the ring band section 104 and applying a force to move the first shank 120*a* and/or the second shank 120*b* towards each other, for example, shown in FIG. 5B.

FIGS. 7-10 are cross-sectional front views of other embodiments of a multifunctional jewelry ring. Some or all of the elements such as the restraining devices and shanks described above, while not shown in FIGS. 7-10, can nevertheless be implemented in the multifunctional jewelry rings 200, 300, 400, and 500, respectively.

Figure 7:
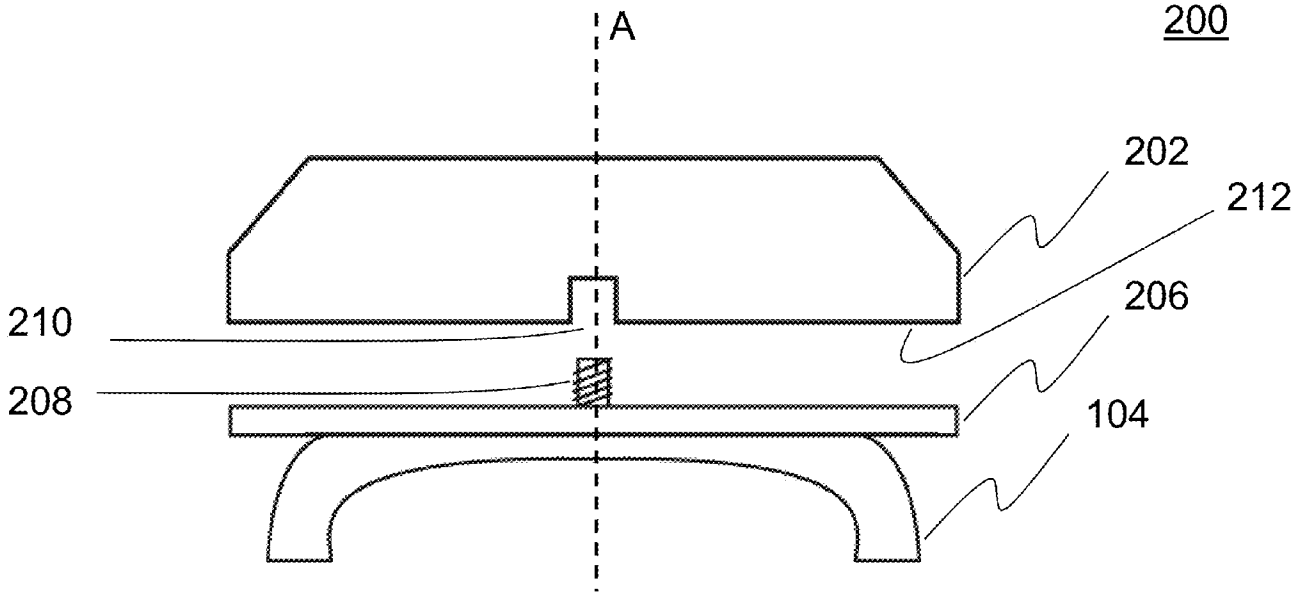
FIG. 7 is a cross-sectional front view of another embodiment of a multifunctional jewelry ring.

In FIG. 7, a jewelry ring 200 comprises a screw 208 that extends from a base 206. The screw 208 can extend from a central region of the base 206. Multiple screws 208 or other fastening devices can extend from different regions of the base 206. The ring top 202 can have a substantially planar bottom surface 212. A threaded opening 210 can extend through the bottom surface 212 for receiving the screw 208. The ring top 202 can be attached to or removed from the base 206 by turning the ring top 202 about an axis A relative to the base 206, or by turning the base 206 about the axis A relative to the ring top 202. While a screw 208 is shown in FIG. 7, one or more other fastening devices or fittings can be coupled to the base 206 and be pressed, threaded, or otherwise secured to the ring top 202. In this manner, the ring top 202 can be removed from the base 206 and replaced with a different ring top according to the decorative or functional needs of the wearer. Thus, different ring tops 202 can be attached to the base 206, each having a unique ornamental configuration, color, jewel, shape, and the like, depending on the requirements of the wearer for reasons related to fashion, function, aesthetic appeal, and the like.

Figure 8:
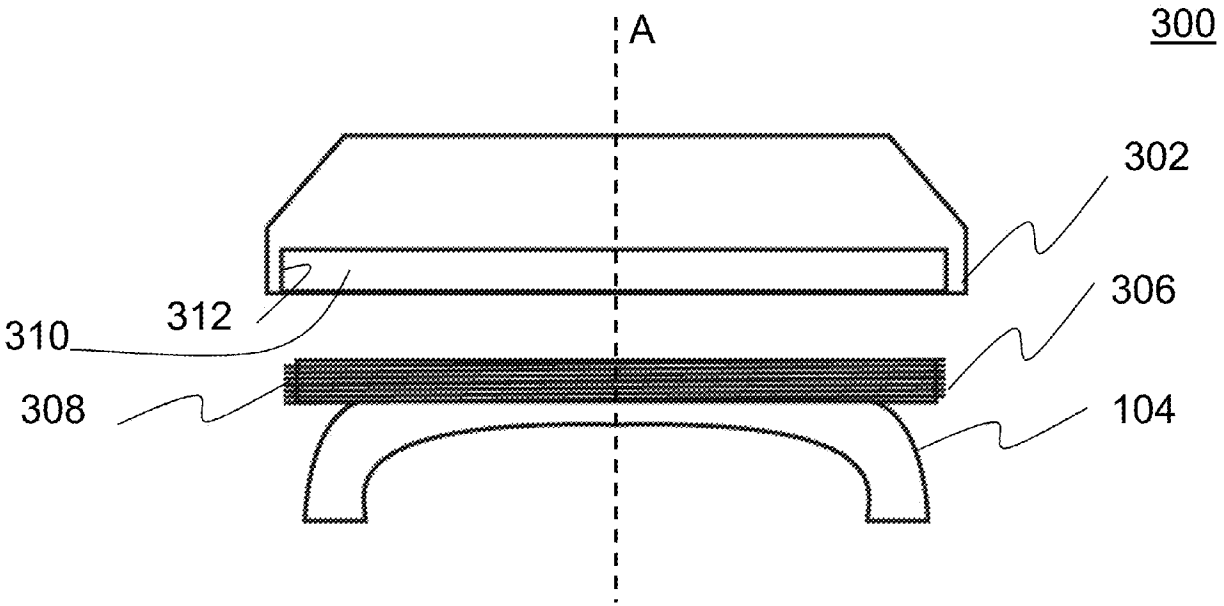
FIG. 8 is a cross-sectional front view of another embodiment of a multifunctional jewelry ring.

In FIG. 8, a jewelry ring 300 includes a region proximal to the perimeter of a base 306, the region having a screw thread 308. A bottom portion of the ring top 302 has an interior wall 312 that likewise includes a screw thread 310 (not shown), which can be interconnected with the screw thread 308 of the base 306. In this manner, the ring top 302 can be attached to or removed from the base 306 by turning the ring top 302 about an axis A relative to the base 306, or by turning the base 306 about the axis A relative to the ring top 302. Thus, the ring top 302 can be screwed to the base 306 via the interconnecting screw threads 308, 310 such that the bottom portion of the ring top 302, more specifically, the interior wall 312, is positioned about the perimeter region of the base 306.

Figure 9:
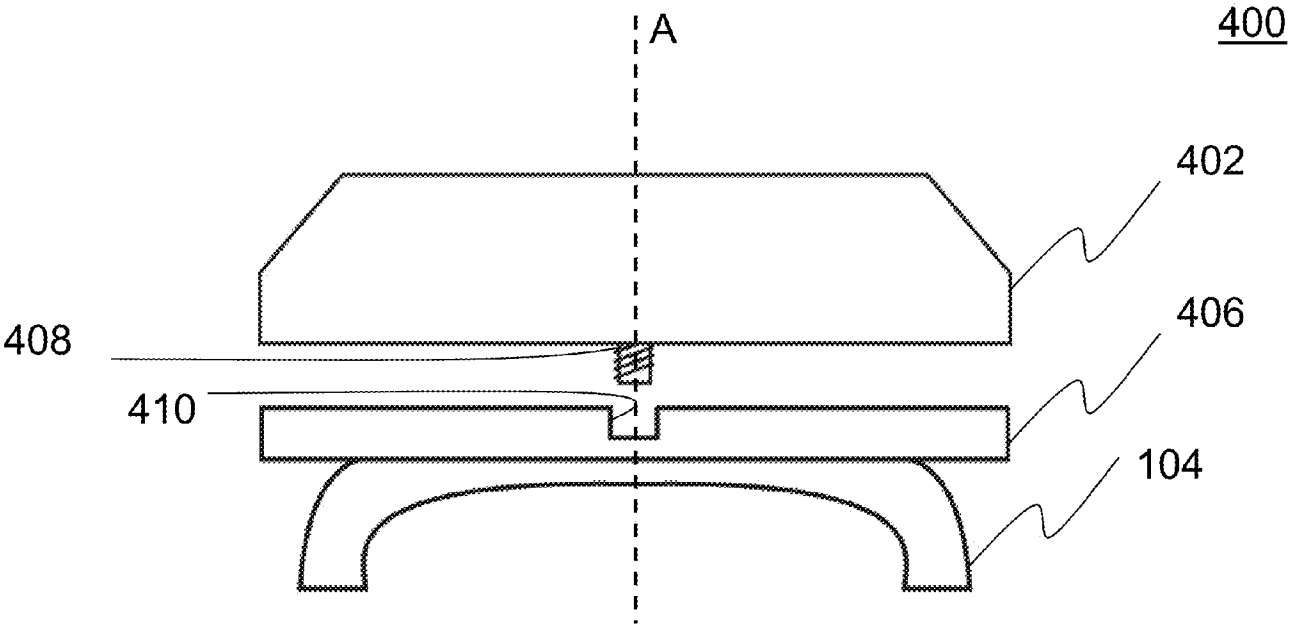
FIG. 9 is a cross-sectional front view of another embodiment of a multifunctional jewelry ring.

In FIG. 9, a jewelry ring 400 comprises a screw 408 that extends from an interior region of a ring top 402. The screw 408 can extend from a central region of the ring top 402. Multiple screws 408 or other fastening devices can extend from different regions of the ring top 402, for example, from an interior wall of a dome-shaped ring top. A threaded opening 410 can extend through a surface of the base 406 for receiving the screw 408. The ring top 402 can be attached to or removed from the base 406 by turning the ring top 402 about an axis A relative to the base 406, or by turning the base 406 about the axis A relative to the ring top 402. While a screw 408 is shown in FIG. 9, one or more other fastening devices or fittings can be coupled to the ring top 402 and be pressed, threaded, or otherwise secured to the base 406.

Figure 10A:
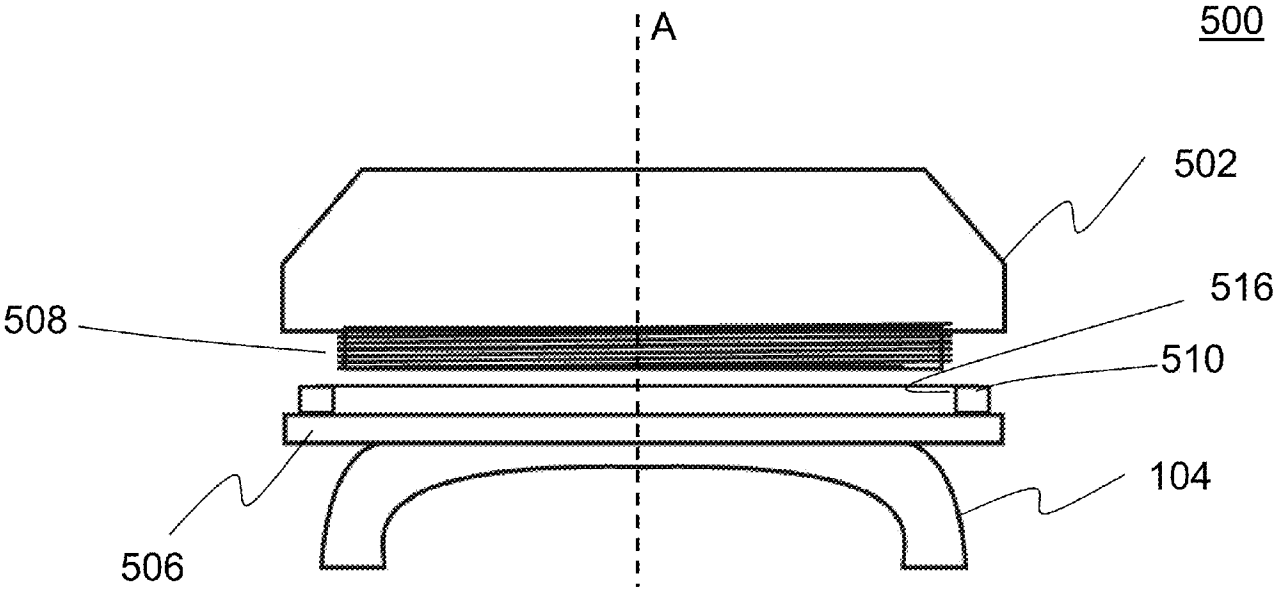
FIG. 10A is a cross-sectional front view of another embodiment of a multifunctional jewelry ring.
Figure 10B:
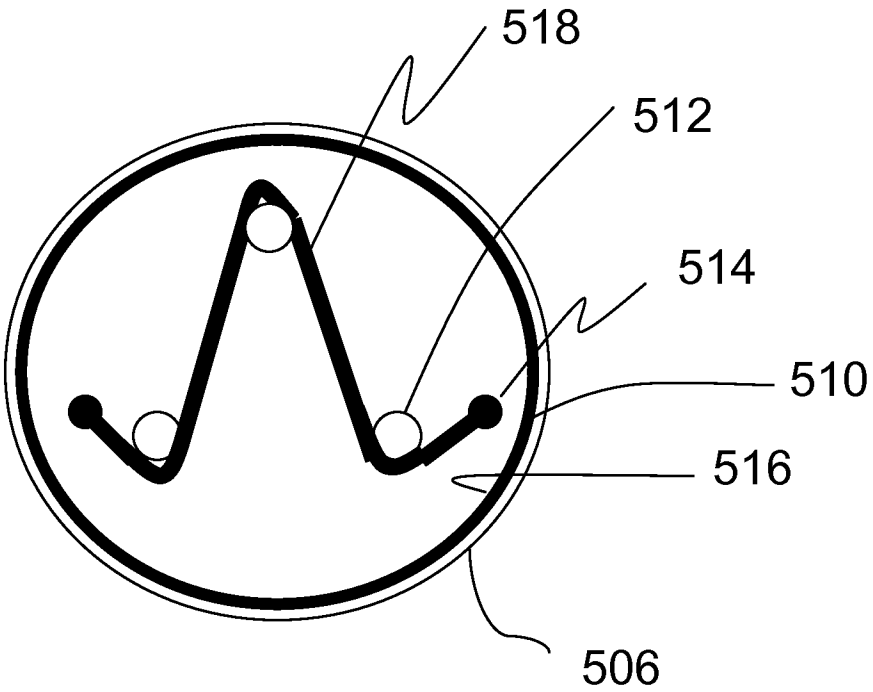
FIG. 10B is a cutaway top view of an embodiment of the interior region of the base of FIG. 10A.

In FIGS. 10A and 10B, a jewelry ring 500 includes a screw region 510 that extends from a peripheral region of a base 506 and surrounds components positioned on the base 506, for example, poles 512, holes 514, restraining device sections 518, and/or other components similar to those described in FIGS. 1-6. A wall 516 of the screw region 510 includes a screw thread. A corresponding screw thread 508 extends from a bottom portion of a ring top 502, which can be interconnected with the screw thread of the screw region 510 of the base 506. In this manner, the ring top 502 can be attached to or removed from the base 506 by turning the ring top 502 including the screw thread 508 about an axis A relative to the base 506, or by turning the base 506 including the screw thread region 510 about the axis A relative to the ring top 502. Thus, the ring top 502 can be screwed to the base 506 via the interconnecting screw threads 508, 510 such that the bottom portion of the ring top 502; more specifically, the screw thread 508 is positioned about the poles 512, the holes 514, and the restraining device sections 518 on the base 506.

While the invention has been shown and described with reference to specific embodiments, it should be understood by those skilled in the art that various changes in form and detail may be made therein without departing from the spirit and scope of the invention.

What is claimed is:

1. A multifunctional jewelry ring comprising:

a ring band section configured to receive at least one of a finger and a bundle of hair;

a base coupled to the ring band section;

a flexible restraining device having a central portion extending through the base and along a top surface of the base and through the ring band section and having first and second end portions extending from a bottom surface of the base, wherein in a first state the restraining device is capable of holding the finger in place against the ring band section and wherein in a second state the restraining device is capable of holding the bundle of hair together against the ring band section, wherein the base includes a plurality of poles extending from the top surface of the base, and wherein the central portion of the restraining device is threaded between the poles extending from the top surface of the base; and an ornamental ring top removably attached to the base and covering the central portion of the restraining device.

2. The multifunctional jewelry ring of claim 1, wherein in the second state the ring band section, the first end portion of the restraining device, and the second end portion of the restraining device form an opening for receiving the bundle of hair.

3. The multifunctional jewelry ring of claim 1, wherein in the first state the ring band section and the first end portion of the restraining device form a first opening and the ring band section and the second end portion of the restraining device form a second opening adjacent the first opening, the first and second openings capable of receiving a finger.

4. The multifunctional jewelry ring of claim 1 further comprising a first shank coupled to an outermost end of the restraining device proximal to the first end portion of the restraining device and a second shank coupled to an outermost end of the restraining device proximal to the second end portion of the restraining device.

5. The multifunctional jewelry ring of claim 4, wherein one of the first shank and the second shank includes a magnetic material for coupling with the ring band section, the base, or the other of the first shank and the second shank.

6. The multifunctional jewelry ring of claim 4, wherein the first shank and the second shank each includes a magnetic material.

7. The multifunctional jewelry ring of claim 4, wherein at least one of the first shank and the second shank has a first surface and a second surface opposite the first surface, a hole extending from the first surface of the at least one of the first shank and the second shank to the second surface of the at least one of the first shank and the second shank for receiving the restraining device.

8. The multifunctional jewelry ring of claim 4, wherein in the first state, the first shank is coupled to a first end of the ring band section and the second shank is coupled to a second end of the ring band section.

9. The multifunctional jewelry ring of claim 4, wherein in the second state, the first shank and the second shank are coupled to each other.

10. The multifunctional jewelry ring of claim 4, wherein the lengths of the first and second portions of the restraining device are determined by the location of at least one of the first shank and the second shank.

11. The multifunctional jewelry ring of claim 1 further comprising a material positioned on the base, wherein the ornamental ring top substantially surrounds the material.

12. The multifunctional jewelry ring of claim 1, wherein at least one of the ornamental ring top and the base includes a fastening device for removably coupling the ornamental ring top and the base to each other.

13. The multifunctional jewelry ring of claim 12, wherein the fastening device includes a thread.

14. The multifunctional jewelry ring of claim 1, wherein the ornamental ring top includes a dome-shaped interior for positioning on the base.

* * * * *